United States Patent [19]

Vartoukian et al.

[11] Patent Number: 4,594,956

[45] Date of Patent: Jun. 17, 1986

[54] METHOD AND APPARATUS FOR SEWING MITERED CORNERS OF BOX TYPE ARTICLES

[75] Inventors: Artin G. Vartoukian, Roselle Park; Robert P. Haggerty, Elizabeth, both of N.J.

[73] Assignee: The Singer Company, Stamford, Conn.

[21] Appl. No.: 702,975

[22] Filed: Feb. 19, 1985

[51] Int. Cl.[4] ..... D05B 1/00; D05B 97/00

[52] U.S. Cl. ..... 112/262.1; 112/121.11; 112/121.15; 112/121.26; 112/104; 112/305; 112/262.3

[58] Field of Search ..... 112/121.11, 121.12, 112/121.15, 121.26, 104, 114, 262.1, 262.2, 262.3, 305, 306

[56] References Cited

U.S. PATENT DOCUMENTS

| | | | |
|---|---|---|---|
| 2,413,891 | 1/1947 | Roy | 112/306 X |
| 3,208,419 | 9/1965 | Frydryk | 112/262.2 |
| 3,669,048 | 6/1972 | Dunn et al. | 112/121.26 |
| 3,921,550 | 11/1975 | Marforio | 112/121.12 |
| 4,541,353 | 9/1985 | Engle | 112/305 X |

*Primary Examiner*—H. Hampton Hunter

*Attorney, Agent, or Firm*—Robert E. Smith; David L. Davis; Edward L. Bell

[57] ABSTRACT

Methods and apparatus are disclosed for forming and securing by stitching articles with mitered corners such as bed sheets or the like in which the mitered corner is contorted into a substantially flat configuration capable of being secured by a straight line of stitching.

13 Claims, 15 Drawing Figures

METHOD AND APPARATUS FOR SEWING MITERED CORNERS OF BOX TYPE ARTICLES

BACKGROUND OF THE INVENTION

This invention relates to methods and apparatus for automatically forming and sewing fitted sheets or the like having box type mitered corners.

The finished fitted sheets, cushions, upholstery covers or the like, to the manufacture of which the methods and apparatus of this invention are directed, are of the type including a substantially planar top surface adapted to bear coextensively against a mattress, seat cushion or upholstery panel, as the case may be, from which top surface marginal side and end panels extend substantially at right angles, the marginal side and end panels being folded into square corners which are secured by stitched seams along their lower edges to define mitered corners adapted to fit over the corners of a mattress, cushion, upholstery panel or the like. Elastic material may be included in the stitched seams to draw in the lower stitched edges of the box type stitched article snuggly around the mattress, cushion or the like to which it is applied.

DESCRIPTION OF THE PRIOR ART

Methods and apparatus for sewing box type articles such as fitted sheets and the like which have been proposed heretofore, such as that disclosed in U.S. Pat. No. 3,208,419, September 28, 1965, have attempted to fold the fabric making up the box type article into a three-dimensional form and to join the folded marginal panels by sewing them while being maintained in three-dimensional form. This required sewing to define the mitered corners by stitching successively in mutually perpendicular directions. The difficulties encountered in shaping the fabric in three-dimensional form and providing for relative shift of the three-dimensionally formed fabric relatively to sewing apparatus in the prior known methods and apparatus for sewing fitted sheets and the like have been detrimental to cost effective commercial success of such prior art proposals.

SUMMARY OF THE INVENTION

The methods and apparatus of this invention proceed on a different basis in accordance with which the mitered corners at each end of a sheet or the like are simultaneously folded into a flat planar configuration which upon being stitched along the marginal edge by a simple straight sewing operation simultaneously form the two box corners at one end of the sheet.

The mitered corners at the opposite end of the sheet or the like may be simularly folded in flat planar configuration and secured by a straight stitched seam formed simultaneously with the seam at the opposite end.

In order to accommodate the formation of flat planar folds to form the mitered corners, this invention comprehends preliminary steps and apparatus for providing sufficient slack in the fabric panel at critical locations within the panel to accommodate formation of temporary folds or wrinkles within the fabric panel as may be necessary to permit linear arrangement of the bottom marginal edges of each end of the fabric panel including the bottom edges of both mitered corners.

In its preferred embodiment, this invention provides a completely automated system for operating on a flat fabric panel drawn from a supply roll or the like and delivering a finished bed sheet or the like with all four corners secured by stitching into mitered form without operator attention.

Included in this invention is a novel organization of work fabric gripping and manipulating instrumentalities effective to transport the fabric panel, to fold a mitered box type corner into a flat planar configuration, and to maintain and guide the folded fabric edge through a sewing operation.

With the above and additional objects and advantages in view as will hereinafter appear, this invention comprises the methods and apparatus hereinafter described and illustrated in the accompanying drawings of a preferred embodiment in which:

FIGS. 1 to 8 represent diagramatic top plan views of an automated system embodying the features of this invention and showing the sequences of position of parts during the formation and securing of all four mitered corners of a bed sheet or the like in which FIGS. 1 and 2 illustrate, respectively, initiation and completion of withdrawal of a fabric panel from a supply roll;

FIG. 3 illustrates location of independent fabric manipulating assemblies over the four corners of the fabric panel;

FIG. 4 illustrates severance of the fabric panel from the supply roll;

FIG. 5 illustrates shift of the fabric manipulating assemblies to produce slack therebetween;

FIG. 6 illustrates operation of the fabric manipulating assemblies to fold mitered corner configuration at each corner of the fabric panel;

FIG. 7 illustrates shift of the fabric manipulating assemblies after formation of mitered corner configuration to remove slack along the edges to be stitched;

FIG. 8 illustrates the position of parts on completion of formation of securing lines of stitches;

FIG. 9 is a perspective view of a mitered corner fabricated in accordance with this invention and shown in three-dimensional form in which it will be arranged when in use over a mattress or the like;

Figure 13:
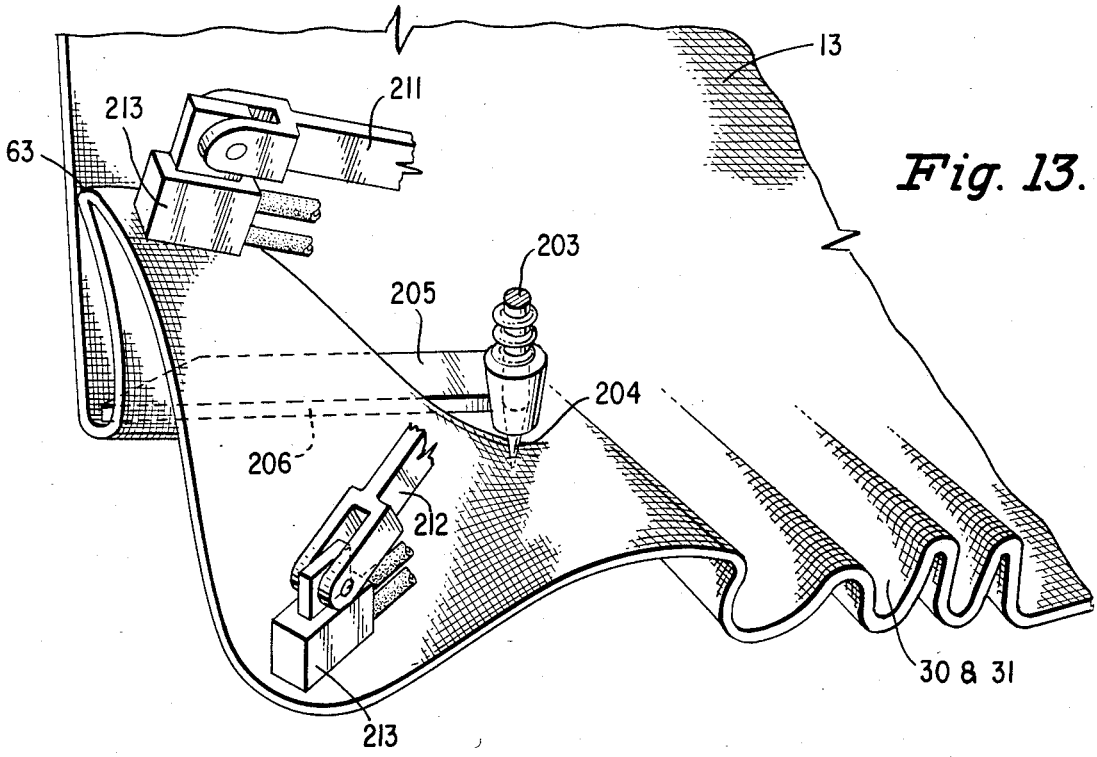
Figure 14:
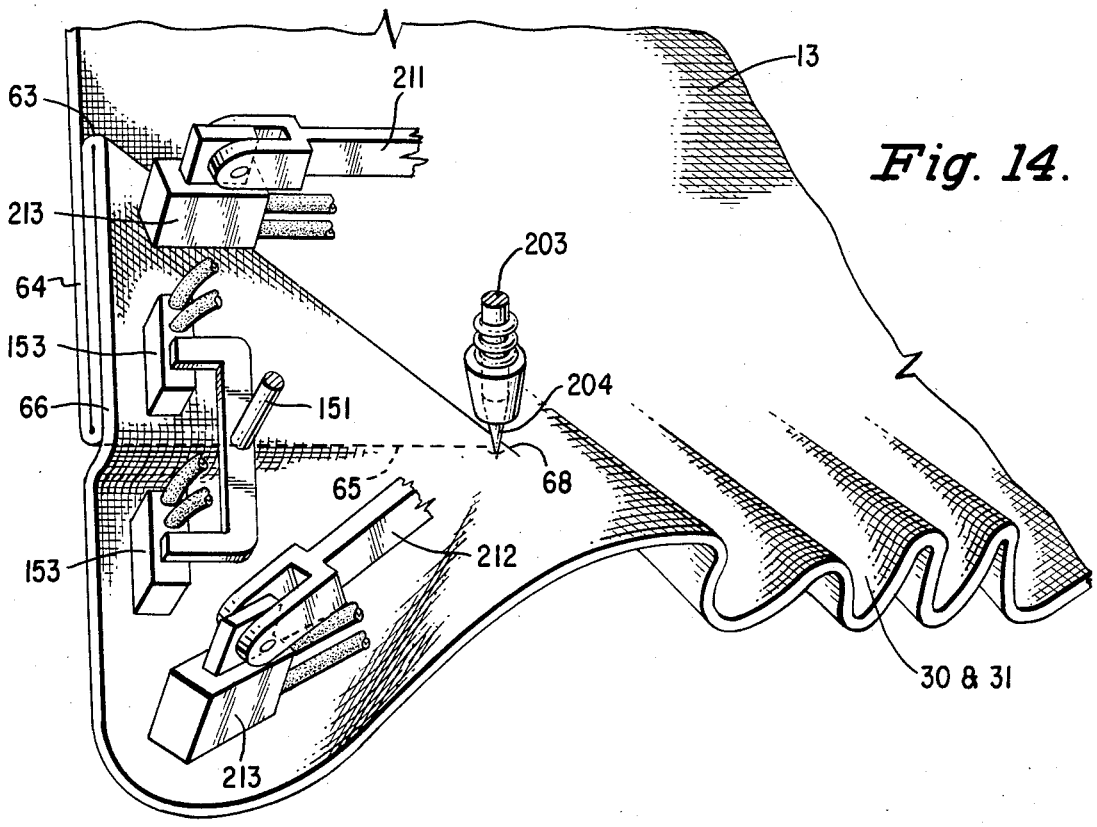

FIGS. 13 and 14 illustrate the fabric engaging portions of the fabric manipulating assembly in the sequence of portions occupied during a typical mitered corner formation and securing operation in which, FIG. 13 illustrates the position of parts midway during the operations of formation of a mitered corner configuration; and FIG. 14 illustrates the position of parts upon completion of formation of the mitered corner configuration and showing the operative positions of auxiliary fabric engaging clamps for assisting in work transport during sewing of the securing seam of stitches.

Referring in the drawings to FIGS. 1 through 8 which illustrate the sequence of operations in an automated system embodying a preferred form of our invention, the general constructions, arrangement and sequence of relative positions of parts of the apparatus of this invention will be described so that the construction and operation of the various elements of this invention, when described in greater detail hereinbelow, can be better understood.

Figure 1:
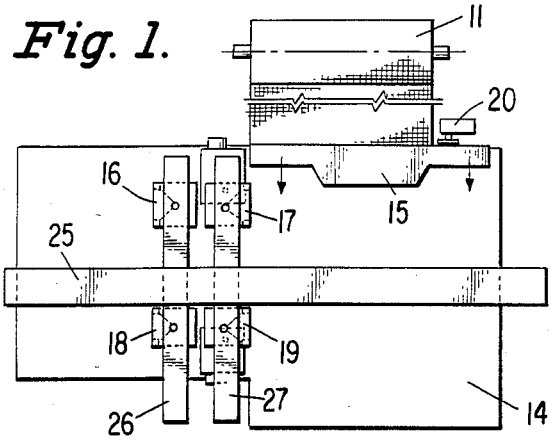
Figure 2:
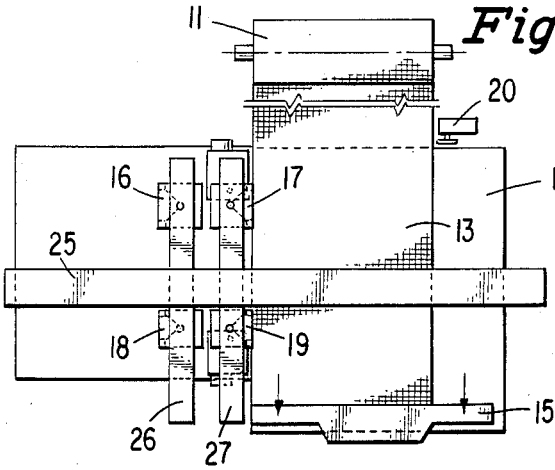
Figure 11:
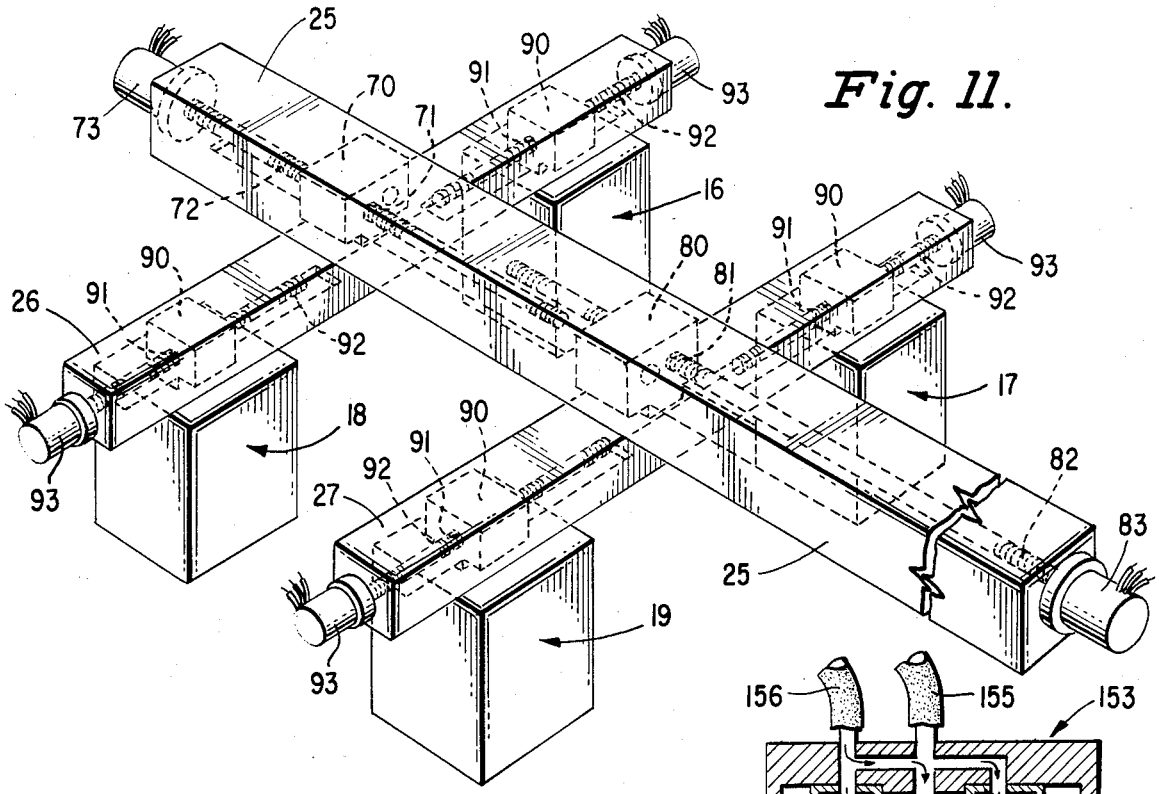
FIG. 11 is a perspective view illustrating the framework for supporting the fabric manipulating assemblies of this invention and the drive means for imparting translatory movement thereto.

As shown in FIGS. 1 and 2, 11 indicates a supply roll of fabric from which a flat fabric panel 13 may be unrolled over a substantially flat work supporting table top 14 by a shiftable fabric gripper 15 driven back and forth across the table top 14 by any suitable means.

Figure 3:
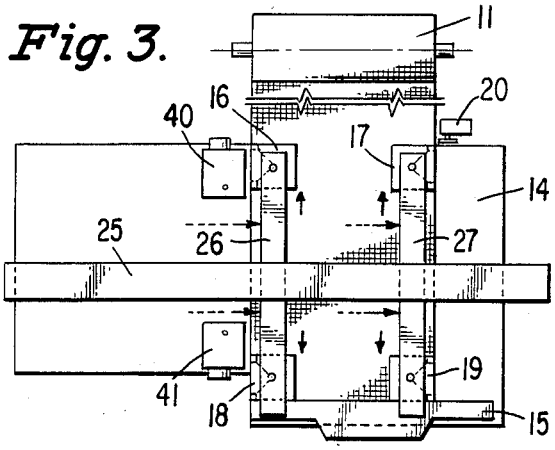
Figure 4:
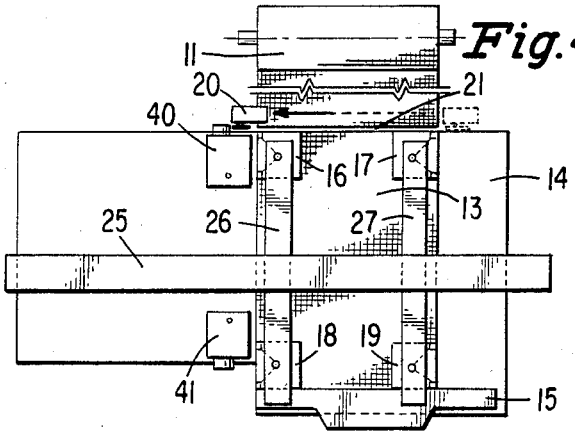

As shown in FIG. 3, each corner of the fabric panel 13 is engaged by a separate fabric manipulating assembly indicated generally at 16, 17, 18 and 19 and, when thus engaged by the assemblies 16 to 19, the fabric panel 13 is severed from the supply roll 11 by the action of a fabric cutter 20 along the line 21 as illustrated in FIG. 4.

As illustrated in FIGS. 1 to 8, a framework is provided for shiftably supporting the fabric manipulating assemblies 16 to 19 above the level of the table top 14. Preferably, the framework includes a main guide rail 25 extending transversely of the direction in which fabric is drawn from the supply roll 11, and two smaller guide rails 26 and 27 each extending perpendicular to and shiftably supported for movement along the main guide rail 25. Fabric manipulating assemblies 16 and 18 are shiftably supported along guide rail 26 and assemblies 17 and 19 are shiftably supported along guide rail 27. As will be described in more detail hereinbelow, provision is included for independently driving each of the guide rails 26 and 27 along the main guide rail 25, and for independently driving each of the fabric manipulating assemblies 16 to 19 along the respective transverse guide rail 26 or 27 on which it is suspended.

The details of construction and operation of the fabric manipulating assemblies 16 to 19 will also be described hereinbelow. For an understanding of the general format of this invention, as shown in FIGS. 1 to 8, it is sufficient to understand that in addition to being shiftable in translation on the framework provided by the rails 25, 26 and 27, each of the fabric manipulating assemblies include various fabric engaging means capable of being lowered into engagement and gripping relation with a fabric panel 13 on the table top, as well as fabric folding and transporting elements together with actuators therefor capable of influencing the configuration of the fabric panel.

Figure 5:
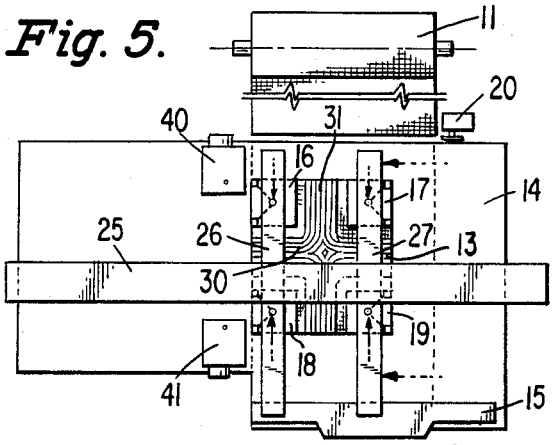

After the fabric panel 13 has been severed from the supply roll as shown in FIG. 4, the fabric manipulating assemblies 16 to 19, each positioned and operated to grip a respective one of the corners of the flat fabric panel, are shifted in translation on the framework 25, 26 and 27 into the positions shown in FIG. 5; assemblies 16 and 17 being shifted toward assemblies 18 and 19 to form therebetween a first region 30 of randomly folded slack extending generally transversely across the fabric panel 13 and assemblies 17 and 19 being shifted toward assemblies 16 and 18 to form therebetween a second region 31 of randomly folded slack extending generally parallel to the directions in which the fabric is withdrawn from the supply roll.

Figure 6:
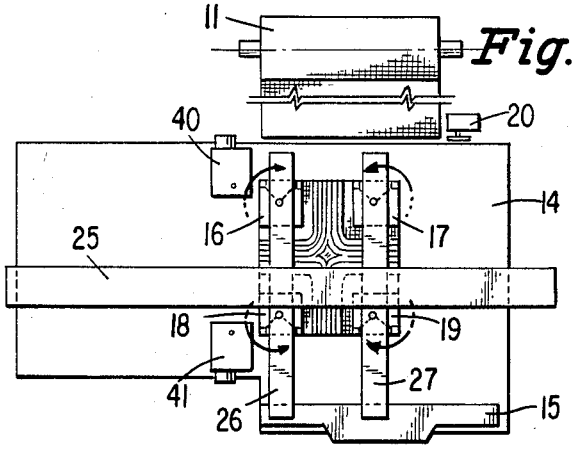

The purpose of providing the regions 30 and 31 of slack in the fabric panel 13 is to provide sufficient loose fabric to accommodate the succeeding operation of the fabric manipulating assemblies as shown in FIG. 6 wherein elements of each assembly are actuated to fold and contort the originally flat fabric corner into a flat configuration which, when secured by marginal edge stitching, will define a mitered corner for a bed sheet or the like.

Figure 7:
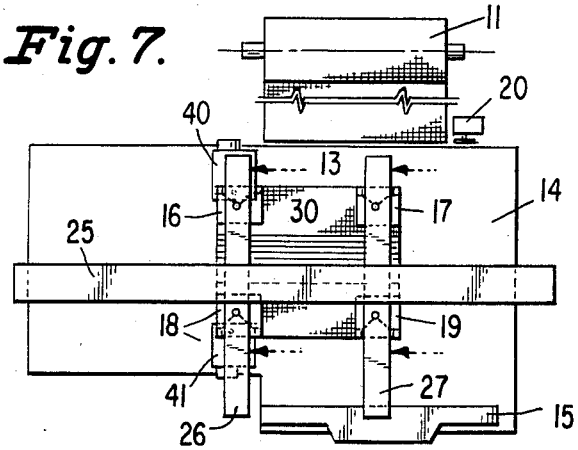

As shown in FIG. 7, after contorting the fabric corners into mitered corner defining configuration, the fabric manipulating assemblies 17 and 19 are shifted in translation away from the assemblies 16 and 18 sufficiently to remove the second region 31 of random slack therebetween after which all four fabric manipulating assemblies 16 to 19 are moved in concert in the direction of the main guide rail 25 to introduce the configured marginal edges at each end of the fabric panel 13 to one of a pair of sewing units 40 and 41 each of the opposite hand.

The sewing units 40 and 41, which may be of conventional construction, include stitch forming instrumentalities for producing a straight line of stitches and are preferably supported each with the line of stitch formation arranged parallel to the guide rail 25 and flush with the table top 14. Each sewing unit may also preferably include presser lifting means, a fabric edge guide, provision for inserting a stitched elastic strip in the stitched seams, and strip and thread severing means for terminating stitched seams all of which may be conventional in the sewing machine art.

Figure 8:
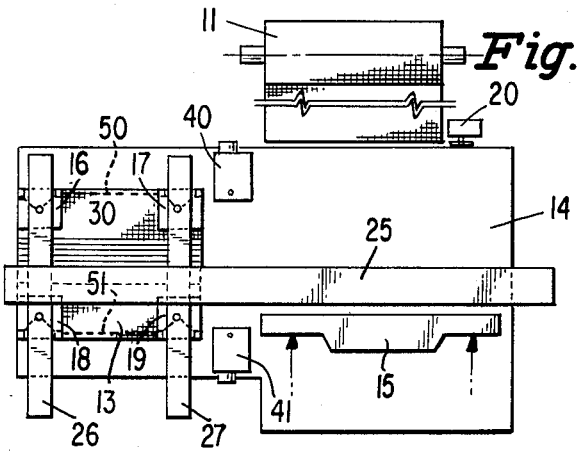

FIG. 8 illustrates the position of the parts after completion of the sewing of marginal edge seams 50 and 51 each seam across one end of the mitered cornered bed sheet or the like. In this stage of an operation, the fabric gripper 15 may be advanced toward the supply roll in preparation for a succeeding cycle of operation. The cycle of operation is completed by actuation of the fabric manipulating assemblies 16 to 19 to release and elevate the fabric engaging means from the fabric panel, return the fabric folding and transporting elements to positions of readiness to begin a succeeding operation and translatory movement of the fabric manipulating assemblies into the positions illustrated in FIG. 1.

FIGS. 1 to 8 illustrate a preferred embodiment in which all four mitered corners of a fitted bed sheet or the like are formed and secured in a single automatic operation. This invention, however, encompasses numerous variations such, for instance, as the formation of a single mitered corner or the formation of only two corners at one end of a fabric panel in each cycle of operation. Where only a single mitered corner or only mitered corners at one end of a fabric panel are to be treated, one or both of the randomly folded slack producing steps may be unnecessary.

Figure 9:
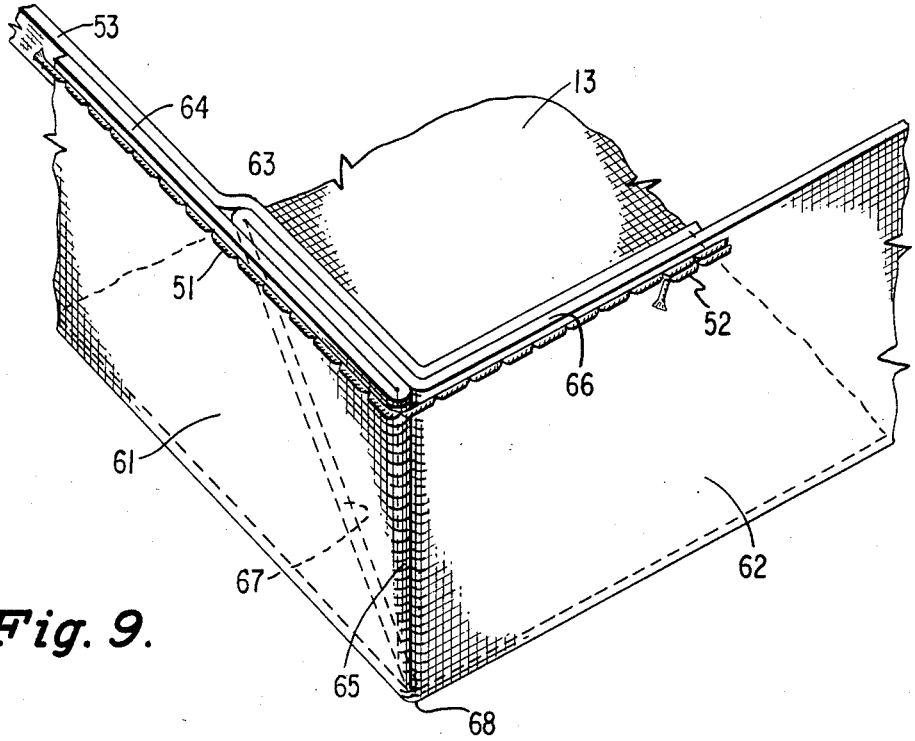
Figure 10:
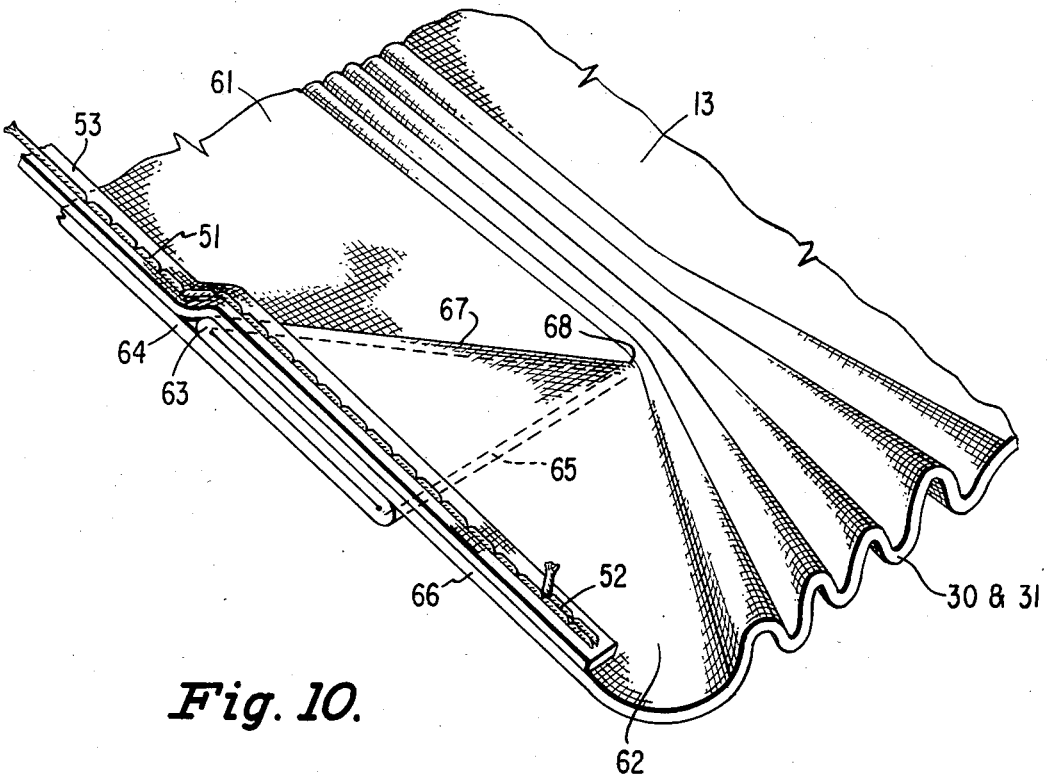
FIG. 10 is a perspective view of the mitered corner of FIG. 9 showing the fabric panel corner edges folded, superposed, and aligned in the arrangement as provided by the fabric manipulating assemblies of this invention suitable for being secured by straight line of sewing machine stitches.

FIGS. 9 and 10 in the accompanying drawings illustrate, respectively, the three-dimensional form in which a mitered corner made in accordance with this invention is utilized, and the contorted form of this mitered corner configuration are provided by this invention to make possible the advantageous securing of the mitered corner configuration by the application thereto of a straight line of stitches.

As shown in FIG. 9, the mitered corner of the fabric panel 13 is formed by the juncture of adjacent marginal portions 61 and 62 of the fabric panel which each extend substantially at right angles to the body portion of the flat fabric panel 13. The apex 63 of the original flat square corner of the fabric panel 13 is arranged against the edge 64 of the marginal portion 61 to form a fold 65 in the marginal portion 61. As shown in FIG. 9, the fold 65 coincides with the juncture of the marginal portions 61 and 62 in the three-dimensional form of the mitered corner. The edge 66 of the marginal portion 62 is positioned in alignment with the edge 64 of marginal portion 61 so as to arrange the folded juncture 67 between the marginal portions 61 and 62 on a diagonal terminating at the apex 68 of the mitered corner. The fabric configuration of FIG. 9 is secured by a stitched seam 51 which extends around the mitered corner and preferably terminates in a back tack 52. A stretched elastic tape 53 may be included in the seam 51. In the interest of clarity, the pucker which release of the stretched elastic tape will form has not been illustrated in FIGS. 9 and 10 and, also for clarity, an edge fold has not been illustrated.

FIG. 10 illustrates the contorted arrangement of the parts of the mitered corner of FIG. 9 as provided by this invention in order to accommodate application thereto of a straight securing seam of stitches 51.

FIG. 11 illustrates the framework for supporting the fabric manipulating assemblies 16, 17, 18 and 19 over the table top 14 and the drive means for imparting translatory movement to the assemblies.

The transverse guide rail 26 includes a block 70 slidably captive within the main guide rail 25 and formed with a threaded aperture 71 engaging a threaded rod 72 carried in the guide rail 25 and driven by a motor 73. Similarly transverse guide rail 27 includes a block 80 slidably captive within the main guide rail 25 and formed with a threaded aperture 81 engaging a threaded rod 82 carried on the guide rail and driven by a motor 83. Motors 73 and 83, therefore, influence translatory movement of the assemblies 16 to 19 in a direction parallel to the lines of stitch formation of the sewing machines 40 and 41.

Each of the fabric manipulating assemblies 16 to 19 includes a block 90 slidably captive within one of the transverse guide rails 26 or 27. Each block 90 is formed with a threaded aperture 91 threadedly engaging a threaded rod 92 carried in the transverse guide rail and driven by a motor 93. The motors 93 thus control the translatory motion of each of the fabric manipulating assemblies independently in a direction perpendicular to the guide rail 25. It will be appreciated that any other known form of translatory drive means for the assemblies 19 to 19 may be employed such as rack and pinion, chains, pneumatic drives or the like.

The preferred form and operation of the fabric manipulating assemblies 16 to 19 of this invention will now be described with particular reference to FIGS. 12 to 14, which figures illustrate one assembly 16, the others being of similar construction and operation.

Figure 12A:
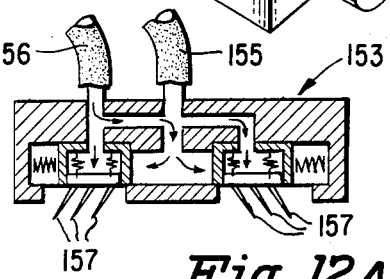
FIG. 12A is an enlarged cross sectional view of a work gripping element of the fabric manipulating assembly shown in FIG. 12.
Figure 12:
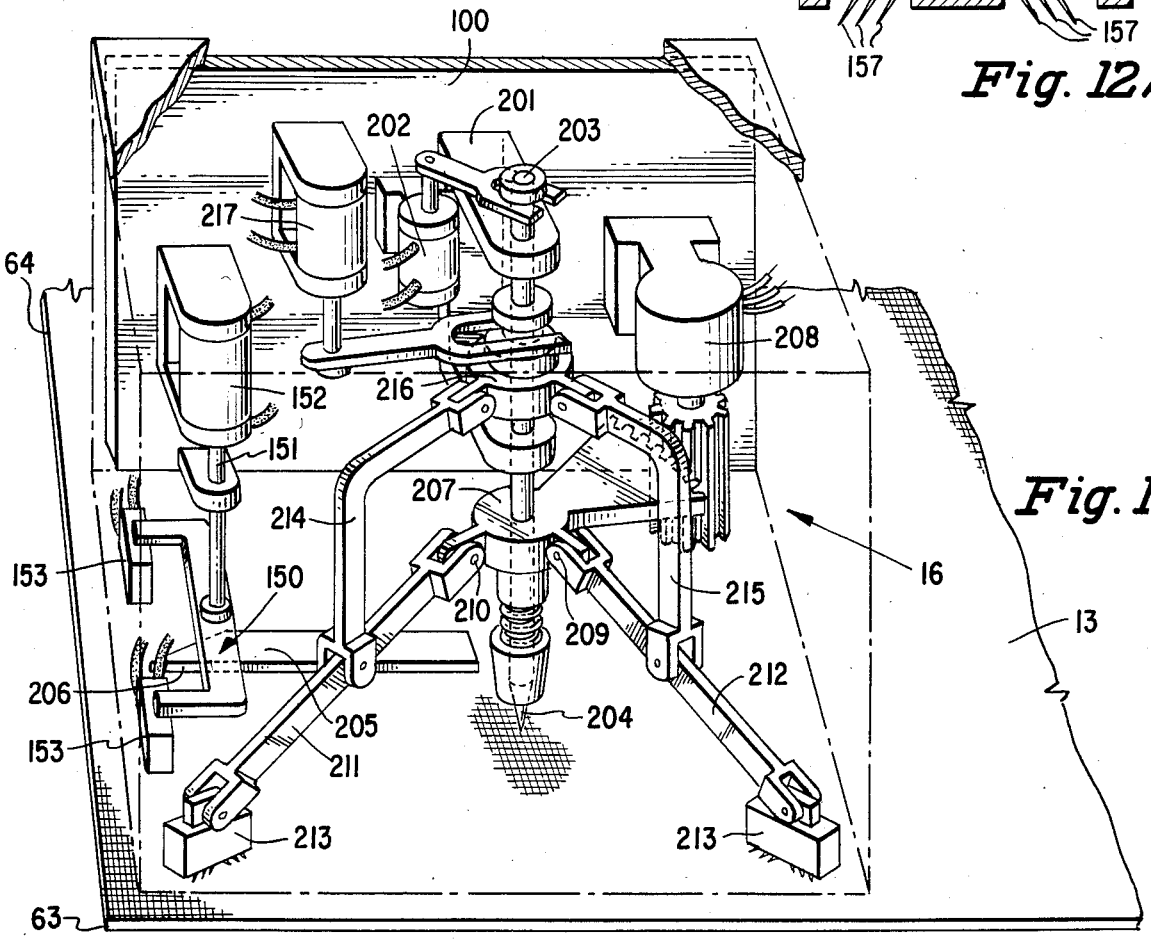
FIG. 12 is a perspective view of partly broken away and illustrated in cross section illustrating one of the fabric manipulating assemblies of this invention together with the various actuators therefore.

As shown in FIG. 12, the assembly 16 includes a frame 100 to which the previously described slide block 90 is secured. A plurality of different work fabric engaging and influencing systems, for instance, the two systems indicated generally at 150 and 200 may be carried independently of each other on the frame 100, each system being arranged for selective movement into and out of work fabric engaging relation and for selective work influencing operation while in engagement with the work fabric.

The first of the two systems 150, which is intended to serve primarily to grip and position or transport the fabric bodily, includes a vertically slidable carrier 151 in the frame 100 controlled by a solenoid or pneumatic cylinder 152 carried on the frame 100 and effective selectively to lower into work engagement or raise out of work engagement one or more work gripping elements 153. Each work gripping element 153, as shown in greater detail in FIG. 12A, preferably comprises spaced slide elements 154, 155 which by selective application of air pressure in an air line 156 may be shifted slightly apart or returned toward each other upon relief of the air pressure. Each slide element 154, 155 may include inclined sharp pins 157 which may be selectively extended or retracted by control of air pressure in an air line 158.

The work gripping elements 153 operate to grip a work fabric upon engagement with the fabric surface by first having the pins 157 extended into the fabric followed by having the carriers 154, 155 shifted apart causing the extended pins to slightly stretch the fabric thereby to secure a firm grip on the fabric. Release of the fabric is obtained by a reverse movement of carriers 154, 155 and retraction of the pins.

The second of the two systems 200, which is intended not only to grip the work fabric for transport thereof, but also to form the mitered corner fold, includes a vertically slidable support 201 in the frame 100 which accommodates a vertically arranged axle 203, the free bottom extremity 204 of which is tapered to form a fabric engaging point defining a pivot axis about which turning movement of the adjoining fabric area is facilitated. An actuator 202 which may comprise a solenoid, pneumatic cylinder or the like is carried by the frame 100 and is effective selectively to lower the axle into work engagment or raise it out of work engagement carrying with it the work folding and shifting apparatus which will now be described.

Fixed to the axle 203 near the point 204 thereof is a thin flat plate 205 adapted to engage flush upon the work fabric when the axle is lowered. The plate 205 is formed with a straight edge 206 arranged to extend substantially perpendicular to the edge 64 of the fabric panel and facing the corner 63 of the fabric panel so as to locate the fold 65 which will eventually be formed about the edge 206.

Rotatable about the axle 203 is a sleeve 207 which may be selectively rotated as by a motor 208. Pivoted to the sleeve at 209 and 210 are a pair of radial arms 211 and 212 spaced angularly at substantially 90° from each other and each carrying at its free extremity a work gripping element 213 which may be constructed and operated in the same manner as work gripping elements 153 of the system 150 described above.

Links 214 and 215 pivoted one to each of the radial arms 211 and 212 are connected in turn to a sleeve 216 slidable on the axle 203. A solenoid, pneumatic actuator or the like 217 on the frame 100 functions on command to slightly elevate the sleeve 216 and by way of the links 214 and 215 and arms 211 and 212 lifts the work gripping elements 213 slightly.

FIGS. 12, 13 and 14 illustrate the sequence of operations by which the system 200 serves to form a mitered corner in the fabric panel as illustrated in FIG. 10. The sequence is as follows: first, the axle 203 is shifted vertically downward by the actuator 202 to carry the flat plate 205 and the tapered bottom extremity 204 of the axle into engagement with the fabric panel 13. By operation of the actuator 217, the work gripping elements 213 are also brought into engagement along the edge 66 of the fabric panel one element 213 adjacent the flat fabric panel corner 63 and the other remote therefrom. The work gripping elements are then actuated to grip the work fabric and the entire system 150, if it had been arranged in fabric engaging position would then be released from gripping relation with the fabric and raised into an inoperative position by the actuator 152.

Referring to FIG. 13, the work gripping elements 213 are then both slightly raised by operation of the actuator 217, following which the work gripping elements 213 are rotated by the motor 208 into the position shown in FIG. 14 in which the fabric side edge 66 is superposed above the fabric end edge 64 and a fold 65 is formed about the straight edge 206 of the flat plate 205. By operation of the actuator 217, the work gripping elements 213 are then lowered to position all of the folded panel parts in the substantially flat planar relationship illustrated in FIG. 10 in which position the parts are ready to be secured by a straight stitched seam.

It will be appreciated that the work gripping and folding system 200, after folding of the fabric as described above and after the fabric manipulating assemblies 16 to 19 are retracted to remove all of the second region of parallel slack 31 therebetween, can serve without additional assistance to transport the folded fabric relatively to the sewing units during the sewing operation. It is also optionally possible to return the work engaging elements 153 of the first system 150 into fabric engaging relation as shown in FIG. 14 after the fabric has been folded by the system 200 to provide enhanced control of the fabric during transport while sewing.

It will be understood that any known form of fabric gripping instrumentalties may be utilized without departing from the scope of this invention and similarly any known form of control systems for supplying a predetermined series of command signals to the various motors, solenoids, pneumatic actuators, etc., may be employed to influence the sequence of operative steps described hereinabove.

Having set forth the nature of this invention, what is claimed herein is:

1. The method of forming and securing a mitered corner of a bed sheet or the like comprising the steps of arranging a substantially right-angle corner of a fabric panel in flat horizontal disposition with one of said right-angle corner edges parallel to a line of stitch formation, engaging said fabric panel along the other of said right-angle corner edges from said corner and for a predetermined distance along said other edge, transporting said engaged fabric panel edge into substantial alignment with said one of the right-angle corner edges, superposing said corner and a portion of said predetermined distance along said other edge over said one edge, and securing said superposed aligned edges together by a straight line of stitches.

2. The method of forming and securing a mitered corner of a bed sheet or the like as set forth in claim 1, including the steps of securing a stretched elastic strip to the superposed aligned edges by said straight line of stitches, and extending said stitched elastic strip in secured relation by said straight line of stitches to both said one and said other right-angle corner edges on both sides of said superposed aligned edges.

3. The method of forming and securing a mitered corner of a bed sheet or the like comprising the steps of arranging a substantially right-angle corner of a fabric panel in flat horizontal disposition, positioning the substantially straight edge of a guide element upon said fabric panel perpendicular to one of said right-angle corner edges in spaced relation to and facing the other of said right-angle corner edges, engaging and transporting the other of said right-angle corner edges into substantial alignment with said one of the right-angle corner edges and over said guide element sufficiently to produce a fold in said one of the right-angle corner edges along the substantially straight edge of said guide element, depositing said transported other of said right-angle corner edges in superposed relation upon said folded one of the rightangle corner edges, and securing said superposed aligned edges together by a straight line of stitches.

4. The method of forming and securing a mitered corner of a bed sheet or the like as set forth in claim 3, including the steps of anchoring said fabric panel against movement at a point adjacent the straight edge of said guide element and substantially equidistant from each of said right-angle corner edges, and transporting the engaged other of said right-angle corner edges in a circular path about the point at which said fabric panel is anchored.

5. The method of forming and securing a mitered corner of a bed sheet or the like as set forth in claim 3, including the steps of securing a stretched elastic strip to the superposed aligned edges by said straight line of stitches, and extending said stitched elastic strip in secured relation by said straight line of stitches to both said one and said other right-angle corner edges on both sides of said superposed aligned edges.

6. The method of forming and securing mitered corners at one end of a bed sheet or the like comprising the steps of arranging in flat horizontal disposition one end of a fabric panel having substantially right-angle corners at each side with one edge of each of said right-angle corners arranged along a common line transversely across said fabric panel and parallel to a line of stitch formation, engaging said fabric panel along each of the other of said right-angle corner edges from each of said corners and for a predetermined distance along each of said other edges, transporting each of said engaged fabric panel edges into substantial alignment with said common line transversely across said fabric panel, superimposing each of said corners and a portion of said predetermined distance along each of said other edges over said one edge of each of said right-angle corners, and securing said superposed aligned edges at each corner together by a straight line of stitches.

7. The method of forming and securing mitered corners at one end of a bed sheet or the like as set forth in Claim 6, including the steps of securing said superposed aligned edges at each corner together by one continuous straight line of stitches and locating said line of stitches between said superposed aligned edges inwardly of said one edges of each of said right-angle corners.

8. The method of forming and securing mitered corners at one end of a bed sheet or the like as set forth in claim 6, including the steps of securing said superposed aligned edges at each corner together by one continuous straight line of stitches and locating said line of stitches between said superposed aligned edges inwardly of said one edges of each of said right-angle corners and securing a stretched elastic strip to said fabric panel by said one continuous straight line of stitches.

9. The method of forming and securing mitered corners at one end of a bed sheet or the like as set forth in claim 6, including the steps of providing slack in said fabric panel between each of said other right-angle corner edges before transporting each of said engaged fabric panel edges into substantial alignment with said common line transversely across said fabric panel, and removing said slack in said fabric panel after superimposing each of said corners and a portion of said predetermined distance along each of said other edges over said one edges of each of said right-angle corners.

10. The method of forming and securing mitered corners at least one at each end of a bed sheet or the like comprising the steps of arranging in flat horizontal position at least that much of a fabric panel including one substantially right-angle corner at each end with one of each of said right-angle corner edges extending parallel to a line of stitch formations producing slack in said fabric panel by shifting said ones of said right-angle corner edges relatively toward one another, forming a mitered corner configuration at each of said at least one corner at each end of said fabric panel by engaging said fabric panel along each of the other of said right-angle corner edges from each of said corners and for a predetermined distance along each of said other edges, folding each of said engaged fabric panel edges into substantial alignment each with the adjacent one of the right-angle corner edges, superposing the corner of each of said transported fabric panel edges and a portion of said predetermined distance along said other edge over said one edge, and securing each of said folded and superposed edges by a separate straight line of stitches by shifting said folded fabric panel in translation to the action of spaced sewing units of the opposite hand while maintaining said slack in said fabric panel.

11. The method of forming and securing mitered corners at one end of a bed sheet or the like as set forth in claim 10, including the step of securing a stretched elastic strip to said fabric panel by each of said separate straight lines of stitches.

12. The method of forming and securing mitered corners at each of the four corners of a rectangular bed sheet or the like comprising the steps of arranging in flat horizontal position a rectangular fabric panel having four right-angle corners with one each of the two right-angle corner edges at each end of the fabric panel extending along a common line transversely across said fabric panel and parallel to a line of stitch formation, producing a first region of slack in said fabric panel by shifting toward each other each end portion of said fabric panel, producing a second region of slack in said fabric panel by shifting toward each other each side portion of said fabric panel, forming a mitered corner configuration at each of the four corners of said fabric panel by engaging said fabric panel along each of the other of said right-angle corner edges from each of said corners and for a predetermined distance along each of said other edges, folding each of said engaged fabric panel edges into substantial alignment each with the adjacent one of the right-angle corner edges, and superposing the corner of each of said transported fabric panel edges and a portion of said predetermined distance along said other edge over said one edge, removing the second region of slack in said fabric panel after superimposing each of said corners and a portion of said predetermined distance along each of said other edges over said one edge of each of said right-angle corners, and securing said mitered corner configuration of both corners at each end of said fabric panel by shifting said folded fabric panel in translation parallel to said line of stitch formation and to the action of spaced sewing units of the opposite hand while maintaining said first region of slack in said fabric panel.

13. The method of forming and securing mitered corners at one end of a bed sheet or the like as set forth in claim 12, including the step of securing a stretched elastic strip to said fabric panel by each of said lines of stitch formation.

* * * * *